United States Patent [19]

Maag et al.

[11] 4,028,874

[45] June 14, 1977

[54] ROVING AND PROCESS FOR ITS MANUFACTURE

[75] Inventors: Fritjof Maag, Kelkheim, Taunus; Friedrich Unger, Hofheim, Taunus; Wilhelm Mohr, Kelkheim, Taunus, all of Germany

[73] Assignee: Hoechst Aktiengesellschaft, Frankfurt am Main, Germany

[22] Filed: Oct. 6, 1975

[21] Appl. No.: 620,149

[30] Foreign Application Priority Data

Oct. 7, 1974 Germany ..... 2447715

[52] U.S. Cl. ..... 57/144; 57/160

[51] Int. Cl.[2] ..... D02G 3/26; D02G 3/38

[58] Field of Search ..... 57/3, 6, 9, 13, 16, 57/17, 18, 144, 160, 152, 163

[56] References Cited

UNITED STATES PATENTS

| | | | |
|---|---|---|---|
| 2,552,210 | 5/1951 | Parker | 57/144 X |
| 3,643,416 | 2/1972 | Andrews et al. | 57/144 X |
| 3,675,409 | 7/1972 | Rosenstein | 57/144 |
| 3,722,202 | 3/1973 | Indarte | 57/144 |
| 3,769,787 | 11/1973 | Rosenstein et al. | 57/144 |
| 3,831,369 | 8/1974 | Northup et al. | 57/152 X |
| 3,857,229 | 12/1974 | Marzocchi | 57/140 C |

*Primary Examiner*—Donald Watkins
*Attorney, Agent, or Firm*—Curtis, Morris & Safford

[57] ABSTRACT

A roving is prepared by winding at least one filament yarn around a fiber strand which is untwisted and unsized and has a total titer of from 1,000 to 30,000 dtex. The filament yarn(s) used for winding have an elongation at break of less than 50% and a titer of less than 50 dtex. The length of cohesion of the roving is in the range of from 15 to 500 meters and one meter of the fiber strand is provided with 20 to 300 windings. The roving can be produced in simple manner and it is excellently suitable for the direct spinning of fine yarns.

7 Claims, 3 Drawing Figures

ROVING AND PROCESS FOR ITS MANUFACTURE

Figure 1:
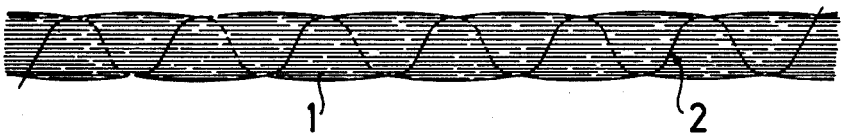

This invention relates to a roving consisting of a sliver of staple fibers and at least one filament yarn wrapped helically around said sliver. The invention also relates to a process for making such a roving.

Rovings are pre-formed structures for the manufacture of staple fiber yarns. Staple fiber yarns are produced on spinning machines, mostly ring spinning machines. Recently, the open-end spinning process is gaining in importance, especially for the manufacture of coarse yarns. In the manufacture of staple fiber yarns there are predominantly required rovings of fine fiber strands which are drawn on the spinning machine to the desired fineness and then mostly consolidated by twisting. Except for very strong fiber strands, for example carded strands, a roving should be slightly strengthened to withstand the mechanical strain on the spinning machine but, on the other hand, it should not be strengthened too much so that drawing and the desired uniform attenuation of the yarn in the drawing frame of the spinning machine is rendered possible and no troubles occur.

Up to now, rovings have been mechanically consolidated by conferring a genuine twist on the sliver, for example on a flyer frame or by inserting a twist in alternating direction by means of a rubbing device, a so-called finisher. In this process the mechanical strength of the roving is determined by the number of applied twists.

The necessity to twist the sliver limits the maximum speed in the manufacture of the roving. Depending on the fineness of the roving and the staple length the feeding rate of the sliver or roving in the manufacture thereof is in the range of from 30 to 100 m/minute. Flyer frames as well as rubbing devices are relatively complicated apparatus. Hence, the economy of the conventional staple fiber yarn production is strongly impaired by expensive machinery and low production rates.

It has been proposed to improve the tensile strength of rovings by helically wrapping one or several filaments around a sliver. U.S. Pat. No. 1,732,592, for example, describes a machine especially suitable for the manufacture of yarns from weak or short fibers by wrapping at least one filament helically around a strand of fibers and then conferring a twist on the composite structure. For the manufacture of yarns the wrapping filaments used are of a type such that the finished yarn has a high strength. Because of their construction and especially of the resulting high strength composite structures of this kind are, therefore, absolutely unsuitable as roving for the manufacture of staple fiber yarns.

U.S. Pat. No. 2,449,595 discloses a plastic material reinforced by a web comprising warp strands of relatively large diameter and helically extending threads wrapped about the strands to bind the fibers of each strand together. Because of its construction and high strength the sliver used as warp cannot be used either as a roving in the manufacture of staple fiber yarns.

It is the object of the present invention to provide a roving which does not have the aforesaid disadvantages, can be produced without much expenditure pertaining to apparatus and the structure and properties of which ensure an undisturbed spinning into staple fiber yarns.

It is another object of the present invention to provide an improved process for the manufacture of staple fiber yarns at a high rate and with relatively uncomplicated apparatus.

These objects are surprisingly accomplished by a roving consisting of a sliver of staple fibers and at least one filament yarn wrapped around said silver, wherein the staple fibers have a total titer of about 1,000 to 30,000 dtex, preferably 2,500 to 15,000 dtex and the wrapping filament yarn has an elongation at break below 50%, preferably below 25%, and a titer of less than 50 dtex and preferably less than 15 dtex, and the roving has a length of cohesion of from 15 to 500 m, preferably 30 to 300 m, and the number of windings of the filament yarn around the sliver is in the range of from 20 to 300, preferably 30 to 100 per meter.

These objects are also accomplished by a process for the manufacture of a roving which comprises wrapping a filament yarn having an elongation at break of less than 50%, preferably less than 25%, and a titer of less than 50 dtex, preferably less than 15 dtex, around a non consolidated staple fiber strand having a total titer of from 1,000 to 30,000 dtex, preferably 2,500 to 15,000 dtex, the filament yarn being wrapped around the staple fiber strand 20 to 300 times and preferably 30 to 100 times per meter and during the wrapping operation the staple fiber strand has a speed of more than 50 and preferably more than 100 meters per minute in axial direction.

The roving according to the invention is suitable for the manufacture of fine yarns having a titer of from 20 to 5,000 dtex. The use of the roving of the invention is not limited, however, to spinning on fine spinning frames, it can also be fed to coarse, medium and fine flyer frames or other machines for the production of rovings.

The roving according to the invention is essentially composed of a fiber strand of staple fibers in parallel relationship to one another and one or more filament yarns of fine titer wrapped helically around the said strand.

The staple fiber strand, i.e. the main component of the roving consists of spinnable natural or man made staple fibers, such as wool, cotton, viscose, or synthetic fibers, preferably polyester, polyamide, polyacrylonitrile, polyolefin, or polyurethane fibers.

The fiber strand is prepared in a manner as usual in worsted spinning, carded yarn spinning, or cotton spinning. In the manufacture of the roving according to the invention it is supplied from a drawing frame.

The staple fibers have an individual titer in the range of from 0.5 to 100 dtex, preferably 1 to 20 dtex and a staple length of 5 to 500 mm, preferably 35 to 150 mm, more preferably 35 to 150 mm.

The thickness of the roving or the staple fiber strand depends on the desired titer of the yarn spun therefrom and is in the range of from 1,000 to 30,000 dtex and preferably 2,500 to 15,000 dtex. The draft on the spinning machine is limited, it lies between about 5 to 300 times and mostly 20 to 50 times the original length, which means that, depending on the titer of the final yarn, the roving should not exceed a definite thickness.

The consolidation of the staple fiber strand according to the invention is brought about not by a twist but by helically wrapping one or several filament yarns, preferably monofilaments, around the staple fiber strand which hold together the fibers and confer upon the strand the desired strength. The filament yarns can be wrapped around the strand in the same or in opposite direction. Wrapping with two filament yarns in opposite direction which cross each other is preferred.

It proved particularly advantageous to confer upon the fiber strand a false twist after it has left the delivery roller of the drawing frame at the point at which the filament yarn is wrapped around. By this false twist the boundary fibers of the broad fiber strand leaving the drawing frame are tied into the roving which acquires a rounder shape. Moreover, the cohesion of the fiber strand between the delivery roller and the point of winding is improved.

A least one filament yarn is wrapped around the fiber strand 20 to 300 times per meter, i.e. in the case of more than one yarn the number of wrappings is the sum of wrappings of all filament yarns.

The wrapping filament yarn has a titer below 50 dtex, preferably below 15 dtex, depending on the thickness and the required or desired mechanical properties of the roving. It is a critical feature of the roving that its strength, which is expresed by the length of cohesion, i.e. the length of the roving which is just self-supporting before disintegrating, is in the range of from 15 to 500 meters, preferably 30 to 300 meters.

The length of cohesion should not be too high as otherwise it would detrimentally affect the draft in the drawing frame of the spinning machine, and, on the other hand, it should not be too low to avoid disintegration of the roving when it is drawn off the roving bobbin, which would result in tearings and false drafts. In the case of using a multifilament yarn as wrapping yarn the titer of the individual filaments can be adapted to the titer of the staple fibers of the strand. It has been observed, however, that different titers of filament and fibers in the finished fine yarn do practically not have a negative effect on the appearance of the goods.

The elongation at break of the filament yarn is below 50%, preferably below 25%. The relatively low elongation of the filament yarn proved to be advantageous so that it is torn at short distances in the drawing frame of the spinning machine. The elongation at break and the tensile strength of the filament yarn are measured according to DIN 53 834 (tensile test on yarns and twisted threads).

The filament yarns to be used consist of regenerated or synthetic textile raw materials such as polyesters, polyamides, polyacrylonitrile, polyolefins, or cellulose. Normally, the very low proportion of the wrapping filament in the finished yarn does not affect the fabric quality. With special shades it may, however, be recommended to select the wrapping filament from a material having the same dyeing properties as the staple fibers.

To wrap the filament yarn or yarns around the non consolidated fiber strand several methods can be used. For example, the filament yarn is wound on small bobbins of small diameter, drawn off the stationary bobbin and passed, together with the fiber strand through the axis of the bobbin whereby the filament yarn is wrapped around the fiber strand. In this case, the number of windings drawn off the bobbin corresponds to the number of wrappings around the fiber strand. It is advantageous to pass the fiber strand through 2 consecutive devices of this type.

It is likewise possible, of course, to pass the non consolidated fiber strand through the bobbin axis and to effect the wrapping when the strand has passed the filament yarn bobbin. In this case the point of wrapping must be fixed by a suitable yarn guide. These two methods are particularly simple as no turning elements are used.

According to another wrapping method the bobbin with the filament yarn is rotated by a drive whilst the fiber strand and the filament yarn are passed through the axis of the yarn bobbin. In this case, too, the filament yarn and the fiber strand can be combined after having passed the bobbin. Wrapping devices of this type permit the use of larger filament yarn bobbins.

When the wrapping process is performed under a tension such that the filament yarn will lie nearer to the core of the strand and the fibers extend outwardly the filament yarn is easily torn during drawing on the spinning machine.

Owing to the fact that the filament yarn can be wrapped at a high speed around the fiber strand the delivery speed of the roving during its manufacture is only limited by the running speed of the drawing frame supplying the fiber strand. The wrapped roving can be wound on cheeses in known manner. According to a preferred embodiment it is folded down in a can. It is fed to the spinning machine and attenuated in a conventional drawing frame. In this operation the filament yarns are torn. The spinning process proceeds the smoother the lower the elongation of the wrapping yarn and the finer the titer of the filaments are. It has been found that rovings in which the wrapping yarn is or are monofilaments having a titer below 15 dtex and an elongation at break of less than 25% can be drawn without any trouble on modern drawing frames operated under high load. With drawing frames operated under low load it may be necessary to wind the roving once around the feed roller.

The roving according to the invention is well suitable for the manufacture of staple fiber yarns.

The following examples illustrate the invention.

EXAMPLE 1

Using a mixture consisting of 55% polyethylene terephthalate staple fibers dtex 3.6 M/75 mm (M mixed titer of 75% by weight dtex 3.3 and 25% by weight dtex 4.0) and 45% wool 21.5 $\mu$ in diameter a roving of 5,900 dtex was prepared on a finisher. The fiber strand of corresponding thickness was not rubbed but 2 polyethylene terephthalate monofilaments of dtex 10, tensile strength 39 g and elongation at break of 6.4% were wrapped around the strand in crosswise manner. During this operation the fiber strand was passed through a tube having a diameter of 12 mm onto which two windings of the monofilament had been applied, the monofilaments of the one winding being passed through the tube together with the fiber strand while the monofilament of the second winding being wrapped in opposite direction around the composite structure of fiber strand and one monofilament leaving the tube. The delivery speed of the roving was 70 meters per minute.

Each monofilament was wrapped around the fiber strand 26.5 times per meter. One meter of roving was thus provided with a total of 53 windings. It had a tensile strength of 145 g and consequently a length of cohesion of 246 meters.

The roving was spun on a long staple ring spinning machine into a yarn of 250 dtex. The number of yarn breakings was normal as well as the evenness of the yarn.

EXAMPLE 2

Using 100% polyethylene terephthalate staple fibers of dtex 3.3/60 mm a roving of 4,000 dtex was produced on a finisher. The fiber strand was not rubbed but 2 polyester monofilaments of dtex 10, tensile strength 39 g and elongation at break 6.4% were wrapped crosswise around the fiber strand. The fiber strand was passed through a tube having a diameter of 8 mm and carrying two windings of the monofilament, the monofilament of one winding being passed through the tube together with the fiber strand while the monofilament of the second winding was wrapped in opposite direction around the composite structure of fiber band and one monofilament after it had left the tube. Each monofilament was wrapped 40 times per meter around the fiber strand so that 1 meter of roving was provided with 80 windings. It had a tensile strength of 108 g and consequently a length of cohesion of 270 meters. On a short staple ring spinning machine the roving was spun into a yarn of 250 dtex. The number of yarn ruptures was normal as well as the evenness of the yarn.

EXAMPLE 3

Using a mixture of 65% polyethylene terephthalate staple fibers of dtex 3.3/38 mm and 35% of rayon staple of dtex 1.7/38 mm a roving of 4,000 dtex was prepared on a cotton flying frame. The fiber strand was not twisted on the frame but wrapped crosswise with two polyethylene terephthalate monofilaments of dtex 10, tensile strength 39 g and elongation at break 6.4%. The fiber strand was passed through a tube having a diameter of 8 mm, onto which tube two windings of the monofilament had been wound. One monofilament was passed through the tube together with the fiber strand while the other one was wrapped crosswise in opposite direction around the composite structure of fiber strand and monofilament after it had left the tube. The delivery speed of the roving was 120 meters per minute.

Each monofilament was wrapped 40 times per meter around the roving, the total number of wrappings being 80 per meter. Its tensile strength was 98 g and, consequently, the cohesion length was 245 meters. The roving was spun on a short staple ring spinning machine into a yarn of 250 dtex. The number of breakings and the evenness of the yarn were normal.

Figure 2:
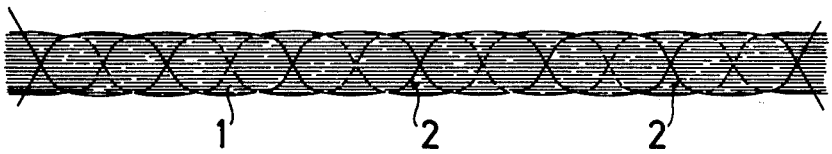
Figure 3:
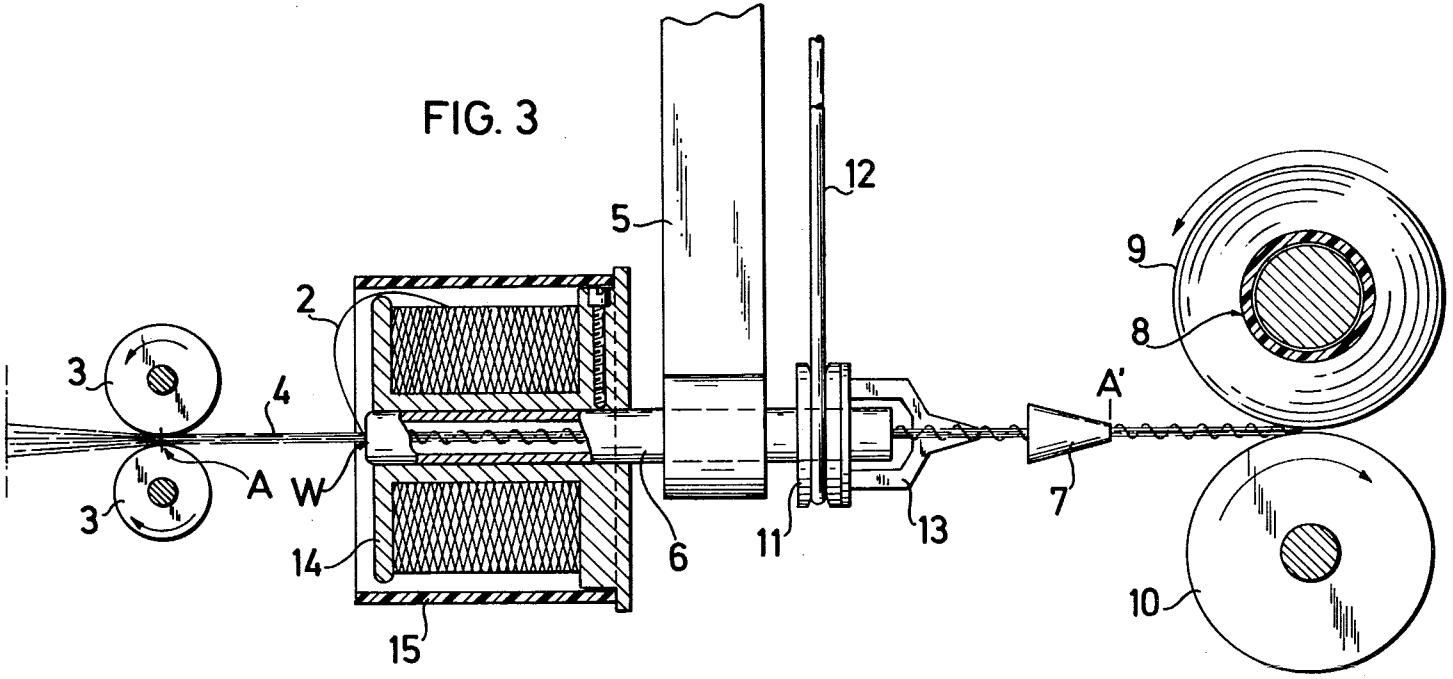

The roving according to the invention is illustrated on the accompanying drawing in which FIGS. 1 and 2 show the roving composed of staple fibers 1 and the wrapped around filament yarn (s) 2. FIG. 3 of the drawing shows by way of example a device suitable for making the roving by the process described in Example 4.

EXAMPLE 4

A fiber strand having a titer of 6,700 dtex was prepared on a finisher from 100% polyethylene terephthalate staple fibers of dtex 1.7/38 mm. The fiber strand was not rubbed but one polyester monofilament of dtex 10, tensile strength 3.3 g/dtex and elongation at break 7.5% was wrapped around the fiber strand using a device as illustrated in FIG. 3. The fiber strand 4 consisting of staple fibers and supplied by the pair of delivery rollers 3 of a drawing frame was passed through tube 6 rotatably mounted in support 5 and wound to a cheese 9 on sleeve 8 via guide 7. The cheese was driven by contact roller 10. Tube 6 rotated at a defined speed, driven by disk 11 and V-belt 12. By an element 13, known from the drawing frame of a condenser ring spinning frame, a false twist was conferred upon the fiber strand 4 between delivery point A and pull-off point A′ for strengthening and rounding off. Bobbin 14 carrying the winding filament 2 was firmly connected with tube 6 so that filament 2 was wound at winding point W around fiber strand 4 when drawn off rotation bobbin 14, and strengthened the fiber strand. The anti-ballooning device 15 slipped on bobbin 14 controlled the tension and the undisturbed running off of the winding filament 2. In the present example the fiber strand was delivered at a rate of 71 meters per minute and the winding filament was wrapped around the strand 45 times per meter. The fiber strand had a tensile strength of 10.9 g, a length of cohesion of 157 m and a titer of 6809 dtex. It was spun on a ring spinning machine with drawing frame for short fibers to give a yarn of 220 dtex. The number of yarn breakings was normal, as well as the yarn strength, elongation and evenness, and corresponded to the values of a yarn spun from a normally twisted flyer yarn.

What is claimed is:

1. A roving consisting of a strand of spun fibers and at least one filament yarn wrapped around said strand, wherein the spun fibers are untwisted and unsized and the strand has a total titer of from about 1,000 to 30,000 dtex and the filament yarn has an elongation at break of less than 50%, the roving has a cohesion length of 15 to 500 meters and the number a wrappings of the filament yarn around the fiber strand is in the range of from 20 to 300 times per meter.

2. A roving as claimed in claim 1, wherein two filament yarns are wrapped in opposite direction to each other around the fiber strand.

3. A roving as claimed in claim 1, wherein the filament yarn is a monofilament.

4. A roving as claimed in claim 1, wherein the filament yarn is a multifilament.

5. A process for the manufacture of a roving having a cohesion length of 15 to 500 meters by wrapping at least one filament yarn around an untwisted strand of fibers, said process comprising the steps of, providing a non-consolidated strand of untwisted and unsized staple fibers having a total titer of from about 1,000 to 30,000 dtex, passing said strand through a wrapping station at a delivery speed of over 50 meters per minute, and wrapping at least one filament yarn, having an elongation at break of less than 50% and a titer of less than 50 dtex, around said non-consolidated strand of staple fibers at said wrapping station at the rate of between 30 to 300 wrappings per meter of strand.

6. A process as claimed in claim 5, wherein the wrapping of the fiber strand is carried out under tension, so that the filament yarn lies nearer to the core of the fiber strand and the fibers extend outwardly.

7. A process as claimed in claim 5, including the step of producing a false twist in the fiber strand after the strand passes through said wrapping station.

* * * * *